US009356333B2

(12) United States Patent
Wada et al.

(10) Patent No.: US 9,356,333 B2
(45) Date of Patent: May 31, 2016

(54) TRANSMISSION LINE RESONATOR, BAND-PASS FILTER AND BRANCHING FILTER

(71) Applicant: The University of Electro-Communications, Tokyo (JP)

(72) Inventors: Koji Wada, Tokyo (JP); Morikazu Sagawa, Tokyo (JP); Mitsuo Makimoto, Tokyo (JP)

(73) Assignee: The University of Electro-Communications, Tokyo (JP)

( * ) Notice: Subject to any disclaimer, the term of this patent is extended or adjusted under 35 U.S.C. 154(b) by 99 days.

(21) Appl. No.: 14/349,873

(22) PCT Filed: Oct. 2, 2012

(86) PCT No.: PCT/JP2012/075536

§ 371 (c)(1),
(2) Date: Apr. 4, 2014

(87) PCT Pub. No.: WO2013/051570

PCT Pub. Date: Apr. 11, 2013

(65) Prior Publication Data

US 2014/0232482 A1 Aug. 21, 2014

(30) Foreign Application Priority Data

Oct. 7, 2011 (JP) ..... 2011-222918

(51) Int. Cl.
*H01P 5/12* (2006.01)
*H01P 7/08* (2006.01)
(Continued)

(52) U.S. Cl.
CPC .. *H01P 7/08* (2013.01); *H01P 1/20* (2013.01); *H01P 1/20381* (2013.01); *H01P 5/184* (2013.01); *H01P 7/082* (2013.01)

(58) Field of Classification Search
CPC ..... H01P 7/08; H01P 7/082; H01P 1/20; H01P 1/20381; H01P 5/184
USPC ..... 333/134
See application file for complete search history.

(56) References Cited

U.S. PATENT DOCUMENTS 5,055,809 A * 10/1991 Sagawa ..... H01P 1/20336 333/204
5,138,284 A * 8/1992 Yabuki ..... H03B 5/1847 331/100

(Continued)

FOREIGN PATENT DOCUMENTS

JP 02-246601 A 10/1990
JP 04-175001 A 6/1992

(Continued)

OTHER PUBLICATIONS

International Preliminary Report on Patentability issued in corresponding International Patent Application No. PCT/JP2012/075536 dated Jun. 24, 2014 (4 pages).

(Continued)

*Primary Examiner* — Robert Pascal
*Assistant Examiner* — Kimberly Glenn
(74) *Attorney, Agent, or Firm* — Osha Liang LLP

(57) ABSTRACT

A transmission line resonator includes distributed coupled lines including first distributed constant line which one ends are connected to a short-circuit grounding portion and second distributed constant line which is disposed in parallel to the first distributed constant line while being separated therefrom by a predetermined distance and which one ends opposing the short-circuit grounded one ends of the first distributed constant line are connected to the short-circuit grounding portion, and a single transmission line which both ends are connected to the respective other ends of the distributed coupled lines.

11 Claims, 14 Drawing Sheets

(51) Int. Cl.

| | |
|---|---|
| ***H01P 1/203*** | (2006.01) |
| ***H01P 1/20*** | (2006.01) |
| ***H01P 5/18*** | (2006.01) |

(56) References Cited

U.S. PATENT DOCUMENTS

| | | | | |
|---|---|---|---|---|
| 5,534,831 | A * | 7/1996 | Yabuki | H01P 1/20381 333/204 |
| 5,742,210 | A * | 4/1998 | Chaturvedi | H01P 5/187 333/116 |
| 2014/0085019 | A1 * | 3/2014 | Mei | H01P 5/184 333/117 |

FOREIGN PATENT DOCUMENTS

| | | | |
|---|---|---|---|
| JP | 2000-183603 | A | 6/2000 |
| JP | 2010-087830 | A | 4/2010 |

OTHER PUBLICATIONS

International Search Report issued in PCT/JP2012/075536 mailed on Dec. 11, 2012 (2 pages).

Sagawa, M. et al.; "Geometrical Structures and Fundamental Characteristics of Microwave Stepped-Impedance Resonators"; IEEE Transactions on Microwave Theory and Techniques, vol. 45, No. 7, Jul. 1997, pp. 1078-1085 (8 pages).

Makimoto, M.; "Structures and Characteristics of Microwave Stepped Impedance Resonators"; The Institute of Electronics, Information and Communication Engineers (IEICE), Technical Report of IEICE, MW2003-221; Dec. 2003, pp. 83-90 (8 pages).

Makimoto, M. et al.; "Microwave Resonators and Filters for Wireless Communication"; Springer, Heidelberg, Germany, Dec. 2000 (5 pages).

* cited by examiner

TRANSMISSION LINE RESONATOR, BAND-PASS FILTER AND BRANCHING FILTER

CROSS-REFERENCE TO RELATED APPLICATIONS

The present application is a U.S. national phase application of International Application No. PCT/JP2012/075536 filed on Oct. 2, 2012, which claims priority to JP Patent Application 2011-222918 filed in Japan on Oct. 7, 2011, the full contents of which are incorporated by reference into the present application.

FIELD OF THE INVENTION

The present invention relates to a transmission line resonator that is used in high frequency circuits, and particularly to a transmission line resonator using distributed coupled lines, a band-pass filter and a multiplexer which use these transmission line resonators.

BACKGROUND OF THE INVENTION

Main types of resonators that are used in high frequency bands and microwave bands are uniform line resonators of quarter-wave type or half-wave type. In these days, stepped impedance resonators (hereinafter also referred to as SIRs) comprised of a plurality of transmission lines of different line impedances as shown in Non-Patent Document 1 are being increasingly used for the purpose of realizing downsizing, spurious suppression or various coupling methods.

There are various configurations for the SIRs. Representative ones are one-end open and other-end short-circuited type SIRs of quarter-wave type and both-end open type SIRs of half-wave type. As shown in the Non-Patent Documents 2 and 3, since downsizing can be best achieved when using quarter-wave type SIRs, active developments and implementations have been made thereof for a long time. In these years, thanks to establishment of process technologies of LTCC (Low Temperature Co-fired Ceramics), quarter-wave SIRs are now often used in microwave band radio system filters as shown in Patent Document 1.

Both-end open type SIRs of half-wave type can be easily realized by using strip lines or microstrip lines, and are practically offered for application as small-sized hairpin resonators or split ring resonators configured in U-shape or rectangular loop-like shape.

However, it has been indicated that downsizing and reduction of loss (or higher Q values of the resonator) do not coexist in both-end open type SIRs of half-wave type. While a both-end short-circuited type SIR might be an option, it will result in a drawback that the resonator increases in size.

PRIOR-ART DOCUMENTS

Patent Document

PTL 1: Japanese Patent Application Laid-Open No. 2010-87830

Non-Patent Document

Non-Patent Document 1: Sagawa, Makimoto and Yamashita, "Geometrical Structures and Fundamental Characteristics of Microwave Stepped Impedance Resonators", IEEE Trans. MTT, vol. 45, No. 7, pp. 1078-1085, July 1997

Non-Patent Document 2: Makimoto, "Structures and Characteristics of Microwave Stepped Impedance Resonators", The Institute of Electronics, Information and Communication Engineers (IEICE), Technology Research Report of IEICE, MW2003-221, pp. 83-90, December 2003

Non-Patent Document 3: Makimoto and Yamashita, "Microwave Resonators and Filters for Wireless Communication", Springer, Heidelberg, Germany, December 2000

As mentioned above, since realization of short-circuit grounding of low impedance has become easy by using LTCC techniques and other factors, it has become possible to configure resonators of both-end short-circuited type. In configuring resonators using uniform lines, the size is limited half-waves. A technique has accordingly been suggested for downsizing a resonator as in Japanese Patent Laid-Open Publication No. 2011-016812 in which a capacitance is loaded to a central portion of the both-end short-circuited type SIR.

However, there are limits in downsizing even if uniform lines are changed to SIRs or loaded with capacitances for the aim of downsizing. Further, in case of both-end short-circuited type SIRs, it is necessary to narrow the line width of transmission lines with short-circuit grounding portions for achieving downsizing which will result in high line impedance in that it becomes difficult to achieve reductions in loss or higher Q values.

SUMMARY OF THE INVENTION

One or more embodiments of the present invention accordingly aims to provide a resonator to achieve both of further downsizing and reductions in loss or higher Q values in a resonator of half-wave type. It further aims to provide high frequency circuits using such resonators.

The inventors have found that resonance frequencies change in accordance with coupling coefficients of the distributed coupled lines in a configuration in which both ends of a single transmission line are short-circuit grounded by means of distributed coupled lines disposed in parallel.

For example, the transmission line resonator with distributed coupled lines according to one or more embodiments of the present invention includes distributed coupled lines comprised of first distributed constant line which one ends are connected to a short-circuit grounding portion and second distributed constant line that is disposed in parallel to the first constant lines while being separated therefrom by a predetermined distance and which one ends that oppose the short-circuit grounded one ends of the first distributed constant line are connected to a short-circuit grounding portion, and a single transmission line which both ends are connected to the respective other ends of the distributed coupled lines. In one or more embodiments, distributed coupled lines have an even mode impedance and/or an odd mode impedance, and the resonance frequency of the transmission line resonator reduces in accordance with increases in the coupling coefficient of the distributed coupled lines which is given by an equation satisfying the following conditions.

$$k=(Zce-Zco)/(Zce+Zco),0\leq k\leq 1$$

(where k is the coupling coefficient, Zce the even mode impedance and Zco the odd mode impedance.)

For example, the band-pass filter according to one or more embodiments of the present invention includes distributed coupled lines comprised of first distributed constant line which one ends are connected to a short-circuit grounding portion and second distributed constant line that is disposed in parallel to the first constant lines while being separated therefrom by a predetermined distance and which one ends that oppose the short-circuit grounded one ends of the first distributed constant line are connected to a short-circuit grounding portion, and a single transmission line which both ends are connected to the respective other ends of the distributed coupled lines. In one or more embodiments, single transmission line has a first line impedance and a first line length, and is disposed in loop-like shape. In one or more embodiments, distributed coupled lines have an even mode impedance and/or an odd mode impedance, and the band-pass filter includes two or more transmission line resonators of identical resonance frequency which resonance frequency reduces in accordance with the coupling coefficient of the distributed coupled lines that is given by an equation satisfying the following conditions, and comprises an input terminal that is coupled to one of the transmission line resonators from among the two or more transmission line resonators and an output terminal that is coupled to another transmission line resonator from among the remaining two or more transmission line resonators. In one or more embodiments, two or more transmission line resonators are disposed and coupled to adjoin each other while being separated from each other by a predetermined distance.

$$k=(Zce-Zco)/(Zce+Zco),0\leq k\leq 1$$

(where k is the coupling coefficient, Zce the even mode impedance and Zco the odd mode impedance.)

For example, multiplexer according to one or more embodiments of the present invention includes distributed coupled lines comprised of first distributed constant line which one ends are connected to a short-circuit grounding portion and second distributed constant line that are disposed in parallel to the first distributed constant line while being separated therefrom by a predetermined distance and which one ends that oppose the short-circuit grounded one ends of the first distributed constant line are connected to a short-circuit grounding portion, and single transmission line which both ends are connected to the respective other ends of the distributed coupled lines. In one or more embodiments, single transmission line has a first line impedance and a first line length and is disposed in a loop-like shape, the distributed constant lines have an even mode impedance and/or an odd mode impedance, and the multiplexer includes two or more band-pass filters obtained by disposing and coupling two or more transmission line resonators of identical resonance frequency to adjoin each other while being separated from each other by a predetermined distance, and the resonance frequency reduces in accordance with the coupling coefficient of the distributed coupled lines which is given by an equation satisfying the following conditions, and further comprises input terminals that are coupled to each of the two inputs of the two or more band-pass filters and output terminals that are coupled to transmission line resonators other than the transmission line resonators that are provided with the respective input terminals from among the two or more band-pass filters. In one or more embodiments, two or more band-pass filters have respectively different passbands.

$$k=(Zce-Zco)/(Zce+Zco),0\leq k\leq 1$$

(where k is the coupling coefficient, Zce the even mode impedance and Zco the odd mode impedance.)

According to the transmission line resonator with distributed coupled lines of one or more embodiments of the present invention, since distributed coupled lines are respectively connected to both ends of a single transmission line resonator of half-wave type and are short-circuit grounded by means of the distributed coupled lines, the line impedance of the short-circuit grounding portion can be lowered so that it is possible to achieve reductions in loss and higher Q values. In one or more embodiments, since the resonance frequency is reduced by increasing the coupling coefficient which is given by the even mode impedance and the odd mode impedance for the distributed coupled lines, it is possible to reduce the size of the resonator provided that the resonance frequency is constant.

By using the transmission line resonator with distributed coupled lines according to one or more embodiments of the present invention, it is possible to realize a large variety of high frequency circuits of small size and low loss such as a multi-staged band-pass filter, a polarized filter, an electronic tuning type filter or a multiplexer.

DETAILED DESCRIPTION OF EMBODIMENTS

In embodiments of the invention, numerous specific details are set forth in order to provide a more thorough understanding of the invention. However, it will be apparent to one with ordinary skill in the art that the invention may be practiced without these specific details. In other instances, well-known features have not been described in detail to avoid obscuring the invention.

The transmission line resonator with distributed coupled lines to which one or more embodiments of the present invention is applied (hereinafter simply referred to as "transmission line resonator" or "resonator"), the band-pass filter, the cross-coupled filter, the electronic tuning type filter and the multiplexer using the transmission line resonator will now be explained in the following order with reference to the drawings.

Figure 1A:
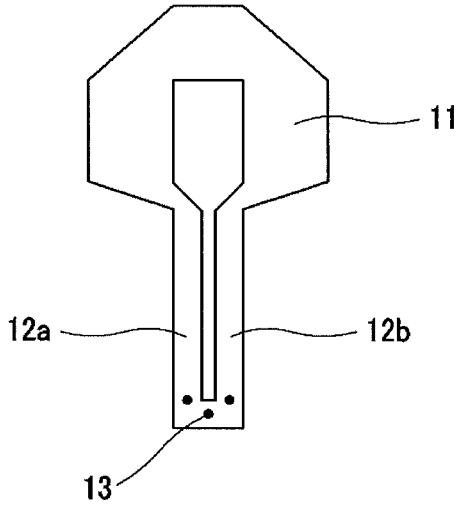
FIG. 1A is a view showing a configuration of a transmission line resonator with distributed coupled lines according to one or more embodiments of the present invention, wherein a short-circuit grounding portion is located at one end opposing the respective distributed constant lines that comprise the distributed coupled lines.

1. Transmission line resonator
1-1. Configuration of the transmission line resonator
1-2. Operating principles of the transmission line resonator
1-3. Design examples of the transmission line resonator
1-4. Modified examples of the transmission line resonator
2. Application circuits of the transmission line resonator
2-1. Band-pass filter
2-2. Cross-coupled filter
2-3. Electronic tuning type filter
2-4. Multiplexer
3. Summary 1. Transmission Line Resonator 1-1. Configuration of the Transmission Line Resonator As shown in FIG. 1A, the transmission line resonator according to one or more embodiments of the present invention includes distributed coupled lines 12*a*, 12*b* comprised of distributed constant lines which are connected to a short-circuit grounding portion 13 at opposing one ends of the distributed constant lines and which are disposed in parallel while being separated from each other by a predetermined distance. Both ends of a uniform line 11 that is formed in a rectangular loop-like shape are connected to the respective other ends of the distributed coupled lines 12*a*, 12*b*. The distributed coupled lines 12*a*, 12*b* that are connected to the short-circuit grounding portion 13 at opposing one ends will hereinafter be referred to as distributed coupled lines of parallel arrangement. The transmission line resonator according to one or more embodiments of the present invention is formed on a dielectric substrate of uniform dielectric constant. The entire rear surface of the dielectric substrate is formed as a conductive pattern. The short-circuit grounding portion 13 is connected to the rear surface conductive pattern through a via. In this respect, the dielectric substrate is not necessarily limited to a double-sided substrate, and it goes without saying that it is possible to use, for instance, a multi-layered substrate having a conductive pattern for short-circuit grounding in an inner layer thereof. Here, the distributed constant lines comprising the distributed coupled lines are denominated as such for discriminating the same from a transmission line that configures the single transmission line that is combined with the distributed coupled lines, and while they are recited hereinafter in a similarly distinguished form, they are functionally transmission lines.

Figure 1B:
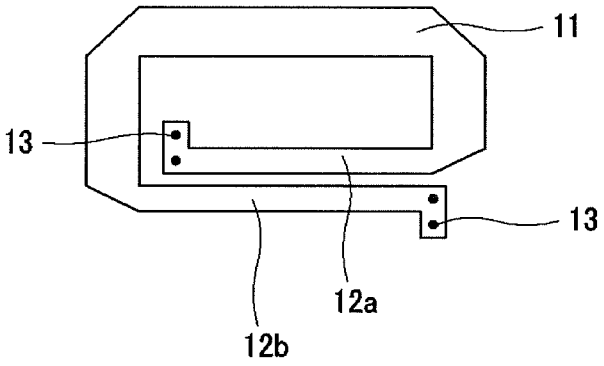
FIG. 1B is a view showing a case in which short-circuit grounding portion is located at respectively opposite ends of the opposing ends of the distributed constant lines that comprise the distributed coupled lines.

FIG. 1B is a view showing a configuration of a resonator for making explanations in contrast to the transmission line resonator as shown in FIG. 1A. The resonator as shown in FIG. 1B includes distributed coupled lines 12*a*, 12*b* which are connected to the short-circuit grounding portion 13 at ends on the opposite side of the opposing one ends of the distributed constant lines of parallel arrangement, and both ends of the uniform line 11 are connected to the respective other ends of the distributed coupled lines 12*a*, 12*b*. The distributed coupled lines 12*a*, 12*b* which ends on the opposite side of the opposing one ends are connected to the short-circuit grounding portion 13 will hereinafter be referred to as distributed coupled lines of anti-parallel arrangement.

1-2. Operating Principles of the Transmission Line Resonator

Operating principles of the transmission line resonator according to one or more embodiments of the present invention will be explained with reference to FIG. 2 and FIG. 3.

Figure 2A:
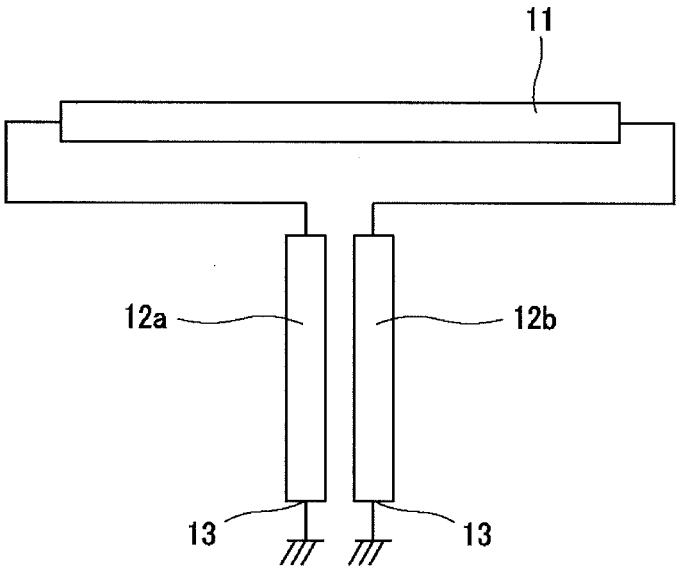
FIG. 2A is a view showing a circuit topology of the transmission line resonator with distributed coupled lines according to one or more embodiments of the present invention as shown in FIG. 1A.
Figure 2B:
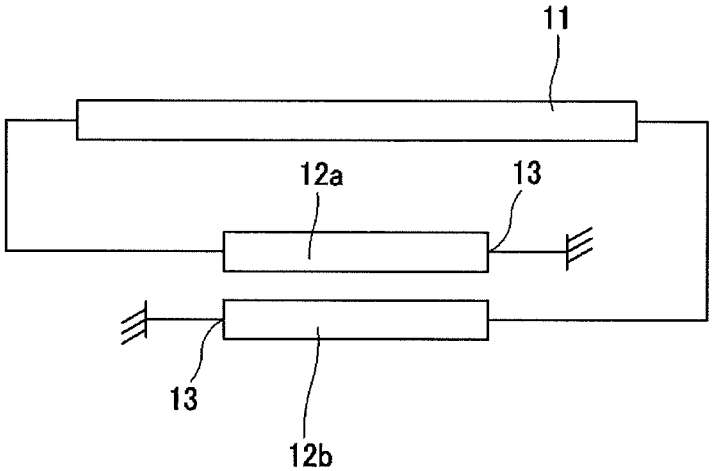
FIG. 2B is a view showing a circuit topology of the transmission line resonator as shown in FIG. 1B.

FIG. 2 is a view in which the resonator having a configuration as shown in FIG. 1 is expressed as a circuit topology for explaining operating principles of the transmission line resonator according to one or more embodiments of the present invention. FIG. 2A shows a circuit topology of a transmission line resonator in which both ends of the uniform line 11 as a single transmission line are connected to the distributed coupled lines 12*a*, 12*b* that are disposed in parallel while being separated from each other by a predetermined distance similar to FIG. 1A. FIG. 2B shows a circuit topology in which both ends of the uniform line 11 are connected to ends on the opposite side of the ends of the distributed coupled lines 12*a*, 12*b* that are connected to the short-circuit grounding portion 13, wherein the distributed coupled lines 12*a*, 12*b* are of anti-parallel arrangement while they are separated from each other by a predetermined distance similar to FIG. 1B.

Figure 3A:
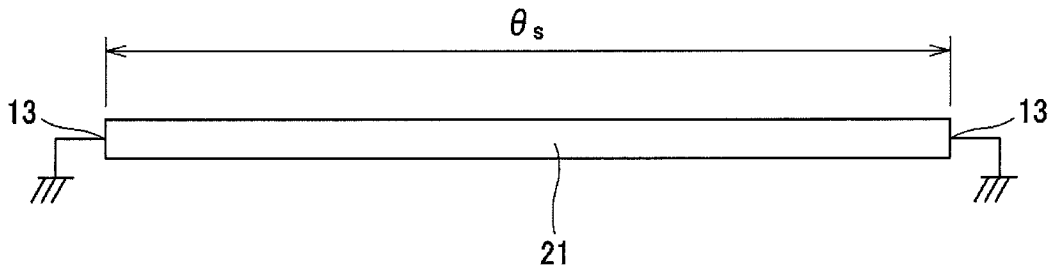
FIG. 3A is a drawing showing a transmission line resonator of both-end short-circuited type using a uniform line according to one or more embodiments of the present invention.

FIG. 3A shows a configuration of a half-wave type transmission line resonator comprised of a uniform line 21 which both ends are connected to the short-circuit grounding portion 13. The line length of the uniform line 21 is $\theta_s$, and under resonance condition of the present transmission line resonator, $\theta_s$ will be 180 degrees.

Figure 3B:
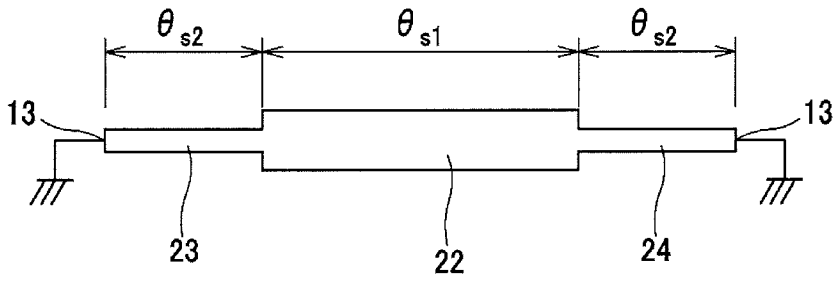
FIG. 3B is a view showing a circuit topology of a both-end short-circuited type stepped impedance resonator according to one or more embodiments of the present invention.

On the other hand, FIG. 3B is a view showing a configuration of a stepped impedance transmission line resonator (hereinafter also referred to as SIR) of both-end short-circuited type. The both-end short-circuited type SIR is configured in that second and third transmission lines 23, 24 having a line length $\theta_{s2}$ and a line impedance $Z_{s2}$ are connected to both ends of a first transmission line 22 having a line length 2 $\theta_{s1}$ and a line impedance $Z_{s1}$, and in that the other ends of the second and third transmission lines 23, 24 are connected to the short-circuit grounding portion 13. Resonance conditions of the both-end short-circuited type SIR are given by the following equation (1).

$$\tan\theta_{s1}\cdot\tan\theta_{s2}=Z_{s1}/Z_{s2}=R_z \tag{1}$$

The length of the both-end short-circuited type SIR becomes shorter than that of the uniform line resonator as shown in FIG. 3A where $R_z<1$, and becomes longer than that of the uniform line resonator as in FIG. 3A where $R_z>1$. Accordingly, when the line impedance is set such that $R_z<1$ is satisfied, it is possible to reduce its size to be smaller than the uniform line resonator at identical resonance frequencies. It should be noted that the both-end short-circuited type SIR becomes a uniform line resonator where $R_z=1$.

On the other hand, in case of a transmission line resonator with distributed coupled lines of parallel or anti-parallel arrangement as shown in FIG. 2A and FIG. 2B, it is necessary to consider the coupling coefficient k of the lines based on even mode impedance and odd mode impedance that the distributed coupled lines have. The coupling coefficient k of the distributed coupled lines is expressed as follows in the case when the even mode impedance is Zce and the odd mode impedance is Zco.

$$k=(Zce-Zco)/(Zce+Zco),0\leq k\leq 1 \tag{2}$$

Here, in the case when the geometric mean impedance is Zc, $$Z_c=(Zce\cdot Zco)^{1/2} \tag{3}$$

For expressing the numerical expression in simplified form, an auxiliary parameter K of coupling is defined as follows.

$$K^2=(1+k)/(1-k)=Zce/Zco\geq 1 \tag{4}$$

At this time, in case of distributed coupled lines of parallel arrangement as shown in FIG. 2A, the short-circuit grounding portion 13 is located at opposing one ends, so that either one of the even or odd modes is entered at the time of resonance. The even mode is entered when the resonance frequency is the lowest, so that the line impedance of the distributed coupled lines of parallel arrangement is given by the following equation.

$$(Z_s/Z_c)/K=R_z=\tan\theta_s\cdot\tan\theta_c \tag{5}$$

On the other hand, in case of distributed coupled lines of anti-parallel arrangement as shown in FIG. 2B, resonance conditions are given by the following equation.

$$(Z_s/Z_c)/K=R_z=2\cdot\tan\theta_s\cdot\tan\theta_c/\{1+K^2+(K^2-1)\sec\theta_c\} \tag{6}$$

Figure 4:
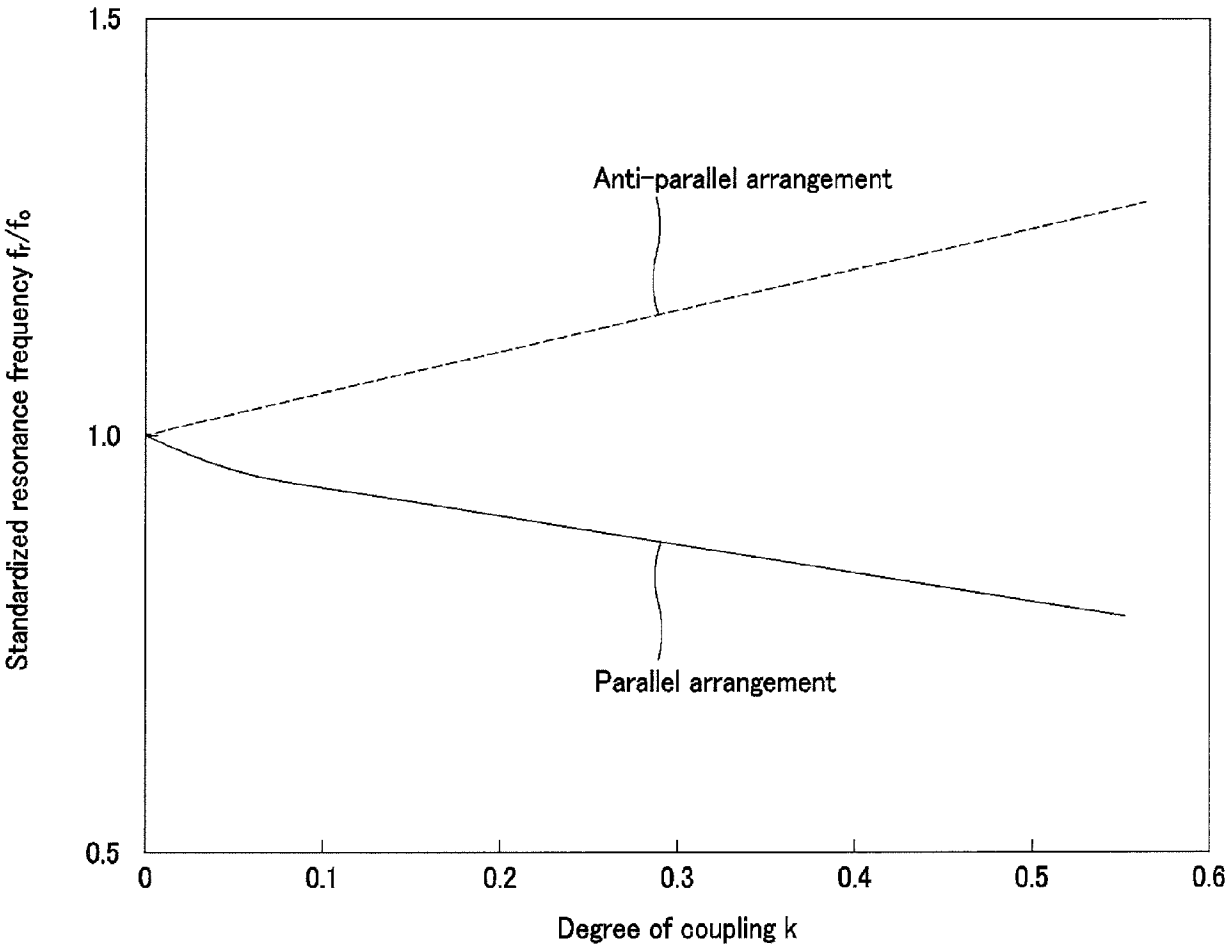
FIG. 4 is a view plotting changes in resonance frequencies with respect to coupling coefficient of the distributed coupled lines of the transmission line resonator with distributed coupled lines of the circuit topology of FIG. 2A (parallel arrangement) and those of the transmission line resonator of the circuit topology of FIG. 2B (anti-parallel arrangement) according to one or more embodiments of the present invention.

In FIG. 4, changes in resonance frequencies $f_r$ in response to changes in the coupling coefficient k are plotted through simulation of the respective circuit topologies of FIG. 2A and FIG. 2B wherein the line length $\theta_s$ of the uniform line 11 and the line length $\theta_c$ of the distributed coupled lines 12*a*, 12*b* were constant. Plotted as the parallel arrangement is a case including the distributed coupled lines of parallel arrangement of FIG. 2A and plotted as the anti-parallel arrangement is a case including the distributed coupled lines of anti-parallel arrangement of FIG. 2B. In this respect, FIG. 4 shows standardized $f_r/f_0$ values with respect to resonance frequencies $f_0$ where $\theta_s=\theta_c=45$ degrees and $Z_c=Z_s$ is satisfied and the coupling coefficient k=0 (K=1).

It can be found from FIG. 4 that the resonance frequency $f_r/f_0$ is reduced by increasing the coupling coefficient k in case of distributed coupled lines of parallel arrangement. A different point of view indicates that it is possible to realize a resonator with a shorter line length by increasing the coupling coefficient k provided that the resonance frequency is identical, so that it is possible to downsize of the resonator. On the other hand, it can be found that, in case of distributed coupled lines of anti-parallel arrangement, the resonance frequency $f_r/f_0$ increases when the coupling coefficient k is increased. Accordingly, no effects of downsizing can be achieved using the coupling coefficient k in case of a transmission line resonator using distributed coupled lines of anti-parallel arrangement. That is, for the purpose of downsizing the resonator, it is necessary to connect distributed coupled lines of parallel arrangement to the single transmission line.

In this respect, as shown in FIG. 2A, the two distributed constant lines comprising the distributed coupled lines 12*a*, 12*b* are preferable to be identical shape and identical properties in view of symmetry of the circuit or ease of design, but they are not necessary to be identical shape and identical properties. It is possible to change the resonance frequency in accordance with the coupling coefficient k that is determined by the even and/or odd mode impedance even if the distributed coupled lines comprised of two distributed constant lines have different shapes and properties.

Figure 5:
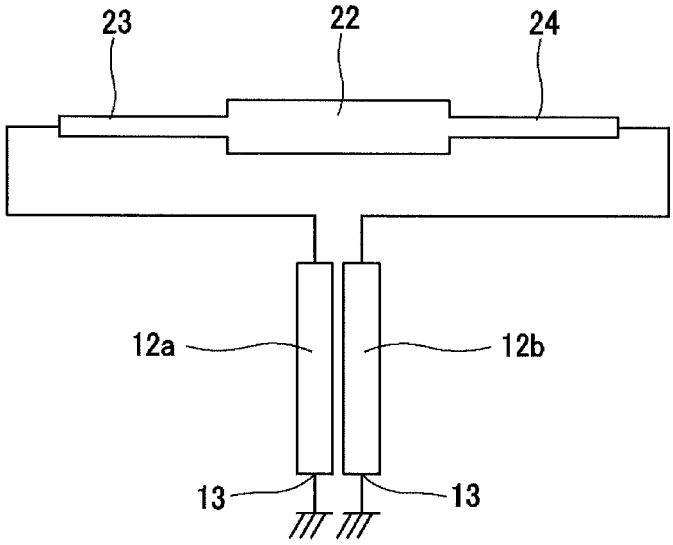
FIG. 5 is a view showing a circuit topology of a transmission line resonator with distributed coupled lines according to one or more embodiments of the present invention in which distributed coupled lines comprised of distributed constant lines of parallel arrangement are connected to both ends of a stepped impedance transmission line resonator.

As shown in FIG. 5, the uniform line 11 of FIG. 2A can be replaced by a SIR comprised of the first transmission line 22 and the second and third transmission lines 23, 24 that are connected to both ends of the first transmission line 22. When the line impedance is set such that $R_z<1$ is satisfied as mentioned above, it is possible to achieve further downsizing when compared to a case using a uniform line.

Figure 6:
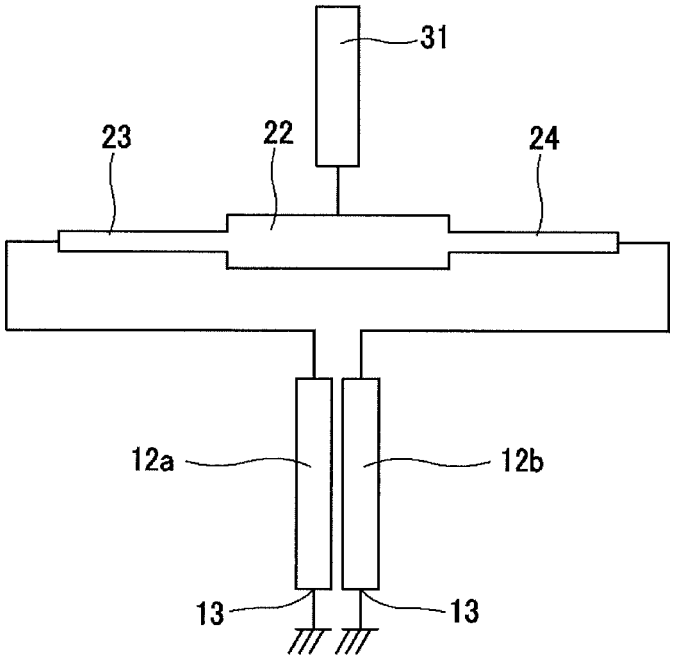
FIG. 6 is a view showing a circuit topology of a transmission line resonator with distributed coupled lines according to one or more embodiments of the present invention in which a capacitive stub is connected to a central portion of the stepped impedance transmission line resonator, which is the resonator of FIG. 5.

Further, as shown in FIG. 6, by connecting a capacitive stub 31 to a central portion of the SIR in FIG. 5, it is possible to achieve further downsizing. Where B is a susceptance of the capacitive stab 31 that is loaded to the central portion of the first transmission line 22 having a line impedance $Z_{s1}$ and a line length $\theta_{s1}$, and the line impedances of the second and third transmission lines 23, 24 are $Z_{s2}$ and $\theta_{s2}$, it is possible to shorten the length of the SIR in comparison with a case when no stub 31 is loaded at identical resonance frequencies by selecting B to satisfy conditions as shown in the following equation (7).

[Numerical Expression 1]

$$B=\frac{R_Z-\tan\theta_{S1}\cdot\tan\theta_{S2}}{Z_{S1}\cdot(\tan\theta_{S2}+R_Z\cdot\tan\theta_{S1})},\quad R_Z=\frac{Z_{S2}}{Z_{S1}} \tag{7}$$

In this respect, while the stub 31 is generally loaded at a central portion of a physical form of the SIR, it is preferable to be loaded at a center of an electric field strength distribution of the SIR, that is, a position at which the electric field strength is maximum.

From a different point of view, it is possible to change the resonance frequency by loading a capacitive element to the central portion of the SIR without changing the shape of the SIR. For instance, it is possible to adjust the resonance frequency by changing capacity values and the line length of the capacitive stub 31. It is also possible to perform minute adjustments of the resonance frequency in combination with trimming techniques in the case when it is necessary to precisely adjust the resonance frequency or to reduce fluctuations in resonance frequencies. In this respect, while a capacitive stub has been employed in FIG. 6 as a capacity that is loaded to the central portion of the first transmission line 22, a concentrated constant capacitor may be loaded, and it is also possible to configure an electronic tuning type resonator to be described later by using a variable capacitance diode. Also in case of employing a capacitive stub, the stub is not only limited to a square-shaped stub but it is of course possible to employ an interdigital type stub, a T-type stub, a stepped impedance type stub or a stub with a folding structure. The object of loading the capacitance is not limited to the SIR and it is also may be an arbitrary transmission line including the uniform line, moreover it is possible to enjoy the benefits of downsizing of the resonator and to perform adjustments of resonance frequencies.

Figure 7:
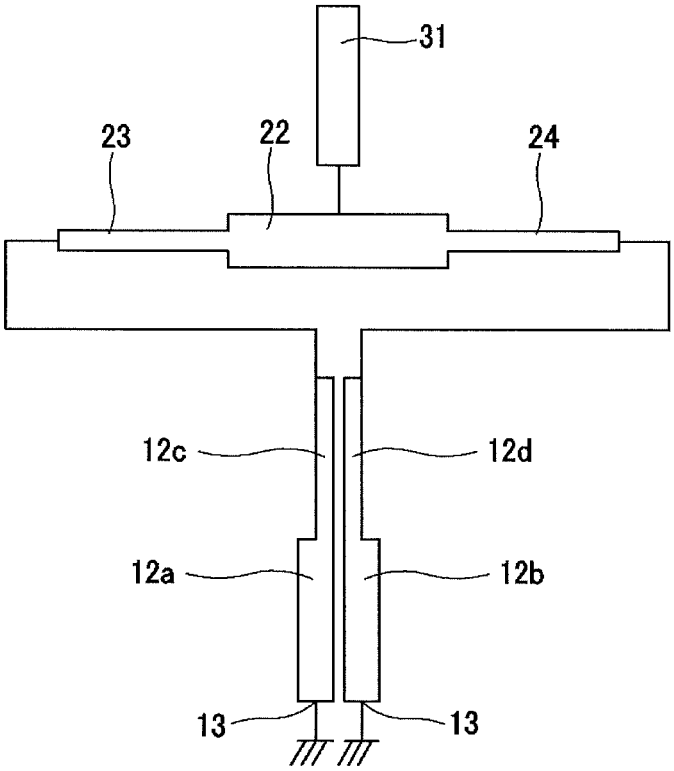
FIG. 7 is a view showing a circuit topology of a transmission line resonator with distributed coupled lines of one or more embodiments of the present invention using serially connected first and second distributed coupled lines of different width instead of the distributed coupled lines of FIG. 6.

As shown in FIG. 7, instead of using the distributed coupled lines 12*a*, 12*b* of parallel arrangement in FIG. 6, it is possible that the resonator includes first distributed coupled lines 12*a*, 12*b* comprised of first and second distributed constant lines of identical shape and identical properties which one ends are connected to a short-circuit grounding portion and which have an even mode impedance $Zce_1$, an odd mode impedance $Zco_1$ and a line length $\theta c_1$ and second distributed coupled lines 12*c*, 12*d* comprised of third and fourth distributed constant lines of identical shape and identical properties which are serially connected to the first and second distributed coupled lines 12*a*, 12*b* and which have an even mode impedance $Zce_2$, an odd mode impedance $Zco_2$ and a line length $\theta c_2$. The coupling coefficient $k_1$ of the first distributed coupled lines 12*a*, 12*b* are expressed as follows.

$$k_1=(Zce_1-Zco_1)/(Zce_1+Zco_1),0\leq k_1\leq 1 \quad (8)$$

The coupling coefficient $k_2$ of the second distributed coupled lines 12*c*, 12*d* are expressed as follows.

$$k_2=(Zce_2-Zco_2)/(Zce_2+Zco_2),0\leq k_2\leq 1 \quad (9)$$

The resonance frequencies change in accordance with the coupling coefficients $k_1$ and $k_2$ as mentioned above.

In the case when the geometric mean impedances of the first and second distributed coupled lines are $Zc_1$ and $Zc_2$, they are expressed as follows.

$$Z_{c1}=(Zce_1\cdot Zco_1)^{1/2},$$

$$Z_{c2}=(Zce_2\cdot Zco_2)^{1/2} \quad (10)$$

Here, in the case when $Z_{c1}\leq Z_{c2}$ is selected to satisfy, it is possible to design widely the line width of the first distributed coupled lines 12*a*, 12*b* that are connected to the short-circuit grounding portion 13 to thereby reduce conductor loss which will result in reductions of loss of the resonator and in improvements in Q values at the time of being unloaded.

While a SIR is employed as the single transmission line in FIG. 7, it is possible to use an arbitrary transmission line including the uniform line instead of the SIR, and with respect to the stub at the central portion of the single transmission line, it is not only limited to a square-shaped stub but it is possible to employ an interdigital type stub, a T-type stub, a stepped impedance type stub or a stub with a folding structure as mentioned above. It is also possible to employ concentrated constant capacitive elements or variable capacitance elements instead of employing these distributed constant elements, and it is certainly possible not to connect any capacitive elements. The distributed constant lines comprising the distributed coupled lines of parallel arrangement are not necessary to be square-shaped, and the coupling coefficient k can be adjusted by removing a part of the distributed constant lines comprising the distributed coupled lines using, for instance, trimming techniques. While it is preferable that the shape and properties of the first and second distributed constant lines are respectively identical to those of the third and fourth distributed constant lines in view of symmetry of the circuit, they are not necessary to be identical as mentioned above.

1-3. Design Examples of the Transmission Line Resonator

Figure 8A:
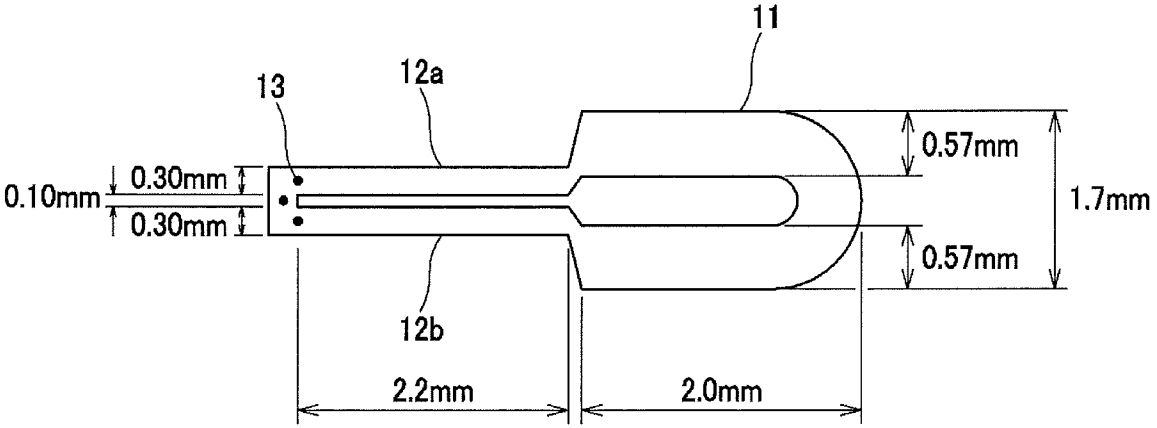
FIG. 8A is a view showing a design example of a transmission line resonator with distributed coupled lines according to one or more embodiments of the present invention.
Figure 8B:
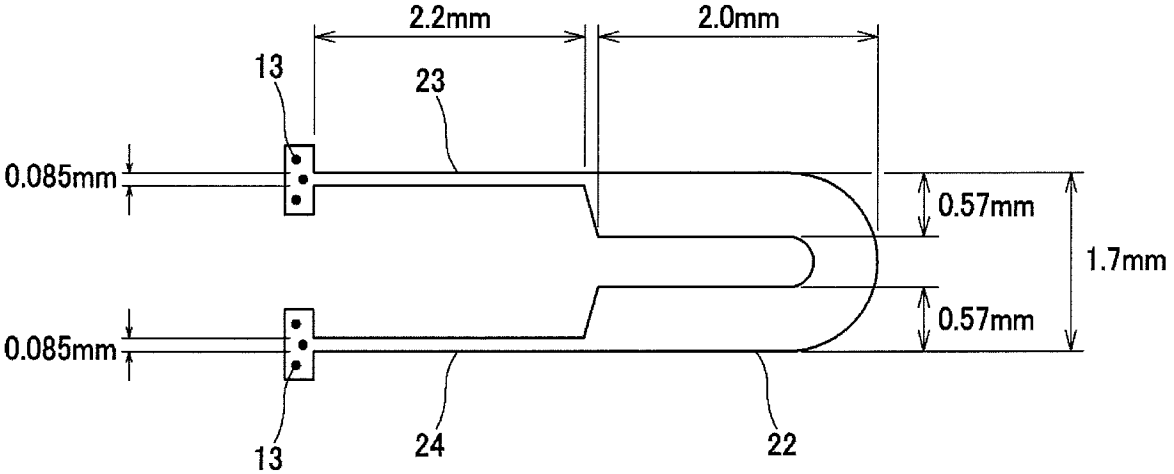
FIG. 8B is a view showing a design example of a stepped impedance transmission line resonator of both-end short-circuited type with a resonance frequency that is identical to that of the resonator as shown in FIG. 8A.

Next, actual design examples of the transmission line resonator including the distributed coupled lines according to one or more embodiments of the present invention will be explained. As shown in FIG. 8A, the resonator according to one or more embodiments of the present invention includes a uniform line 11 formed in a U-shaped loop and distributed coupled lines 12*a*, 12*b* of parallel arrangement that are connected to both ends of the uniform line 11, and one ends of the distributed coupled lines 12*a*, 12*b* are connected to a short-circuit grounding portion 13. The uniform line 11 is a transmission line having a width of 0.57 mm, and the width of the U-shaped loop is 1.7 mm and its length is 2.0 mm. The distributed coupled lines 12*a*, 12*b* are configured by disposing distributed constant lines of 0.30 mm width each to be separated from each other by a distance of 0.10 mm. The short-circuit grounding portion 13 is connected to a pattern formed on the rear surface (not shown) through a via. Such a pattern was formed as a microstrip line using a dielectric substrate having a dielectric constant of 10.2 and a dielectric tangent (tan δ) of 0.0023. Here, the resonance frequency was set to 5 GHz. The impedance ratio $R_z$ which determines the size of the resonator was set to be 0.53. Unloaded Q value of this resonator according to one or more embodiments of the present invention obtained through simulation was 225. On the other hand, FIG. 8B is a pattern example of a U-shaped loop both-end grounded type SIR formed on the same dielectric substrate under the same conditions as FIG. 8A, that is, by setting the resonance frequency to 5 GHz and the impedance ratio $R_z$ to 0.53. The line width of the first transmission line 22 was set to 0.57 mm similar to the case of FIG. 8A, and the loop width was set to 1.7 mm and the loop length to 2.0 mm. By setting the line length of the second and third transmission lines 23, 24 to be identical to the line length of the distributed coupled lines 12*a*, 12*b* in the case of FIG. 8A, the line width became 0.085 mm. Due to the fact that the line width of the second and third transmission lines 23, 24 that are connected to the short-circuit grounding portion 13 has become narrower, it was found through simulation that the unloaded Q value of the both-end short-circuited type SIR as shown in FIG. 8B was 165 and thus lower than the unloaded Q value of the resonator according to one or more embodiments of the present invention.

Therefore, according to the resonator of one or more embodiments of the present invention, it is possible to make the line width wider that is connected to the short-circuit grounding portion and to realize reduction of loss and higher Q values provided that the resonance frequencies and the sizes of the resonators are identical.

1-4. Modified Examples of the Transmission Line Resonator

As shown in FIG. 9A to FIG. 9E, the resonator according to one or more embodiments of the present invention can be formed into various shapes based on the above-mentioned circuit topology.

Figure 9C:
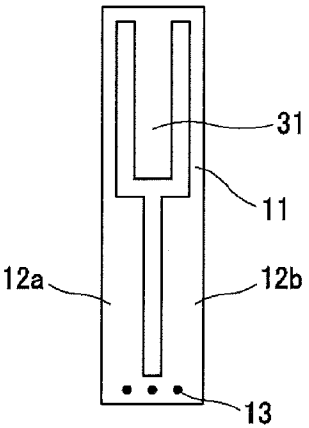
FIG. 9A to FIG. 9E are views showing various modified examples of the transmission line resonator with distributed coupled lines according to one or more embodiments of the present invention.
Figure 9B:
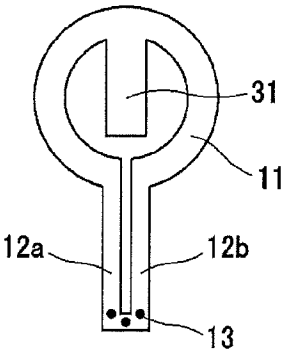
Figure 9A:
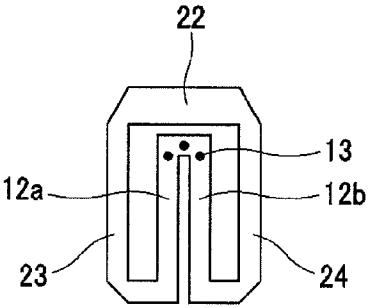

The configuration as shown in FIG. 9A corresponds to the above-mentioned circuit of FIG. 5 as circuit topology. The second and third transmission lines 23, 24 are connected to both ends of the first transmission line 22 so that they configure a SIR disposed in a rectangular loop-like shape. The distributed coupled lines 12*a*, 12*b* are connected to both ends of the SIR. The distributed coupled lines 12*a*, 12*b* are then disposed within the SIR formed into a rectangular loop-like shape and are connected to the short-circuit grounding portion 13 within the SIR formed into a rectangular loop-like shape. With this configuration, it is possible to make the size of the resonator compact and to achieve coupling of resonators by disposing a resonator of similar configuration to separate from each other and thus to easily configure a filter circuit as described later.

The configuration as shown in FIG. 9B corresponds to the above-mentioned circuit of FIG. 6 as circuit topology. However, the single transmission line is not a SIR as shown in FIG. 6 but a uniform line 11. The uniform line 11 is disposed in a circular loop-like shape whereupon the distributed coupled lines 12*a*, 12*b* of parallel disposition are connected to both ends of the uniform line 11 while the other ends of the distributed coupled lines 12*a*, 12*b* are connected to the short-circuit grounding portion 13. A square-shaped stub 31 is further connected to a central portion of the uniform line 11. In FIG. 9B, the resonator can be downsized by disposing the square-shaped stub 31 within the circular loop of the uniform line 11.

The configuration as shown in FIG. 9C is identical to that of FIG. 9B and the resonators are identical as circuit topology. While FIG. 9B is configured by the uniform line 11 disposed in a circular loop-like shape, the configuration of FIG. 9C employs a uniform line 11 that is disposed in an elongated rectangular loop-like shape. In this manner, according to the resonator of one or more embodiments of the present invention, it is possible to design shapes of the resonator with more flexibility in accordance with properties of the resonators or restrictions regarding installation space or the like.

Figure 9E:
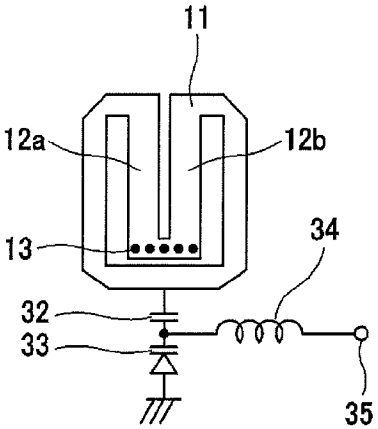
Figure 9D:
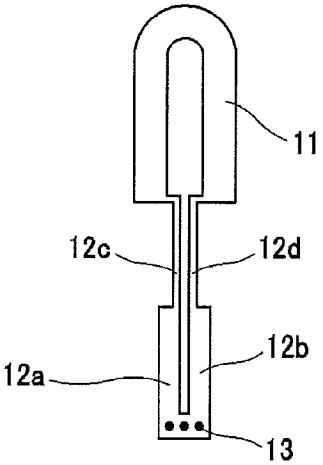

The configuration as shown in FIG. 9D corresponds to the circuit of FIG. 7 as circuit topology but the capacitive stub as shown in FIG. 7 has been removed. The other ends of the first distributed coupled lines 12*a*, 12*b* which one ends are connected to the short-circuit grounding portion 13 are connected to the one ends of second distributed coupled lines 12*c*, 12*d*, and the other ends of the second distributed coupled lines 12*c*, 12*d* are connected to both ends of the uniform line 11 disposed in form of a U-shaped loop. As mentioned above, by defining the width of the first distributed coupled lines to be wide, it is possible to realize reductions of loss and higher Q values.

The configuration as shown in FIG. 9E is an electronic tuning type resonator which resonance frequency can be changed through external voltage. It is possible to configure a voltage-controlled oscillator or an electronic tuning type filter by using the electronic tuning type resonator as described later. The circuit topology of the electronic tuning type resonator as shown in FIG. 9E corresponds to the circuit of FIG. 6, and the single transmission line is not a SIR but a uniform line 11. The electronic tuning type resonator uses a DC block capacitor 32 and a variable capacitance diode 33 that are serially connected as a capacitive element that is loaded to the central portion of the uniform line 11, and an external voltage terminal 35 is connected to a connecting position of the DC block capacitor 32 and the variable capacitance diode 33 by means of a high frequency choke coil 34. Since the variable capacitance diode 33 has generally a large loss, it is also possible to employ a plurality of types of concentrated constant capacitive elements with a low loss such as laminated ceramic capacitors or the like instead of the variable capacitance diode and those are converted by means of a switch in cases when resonance frequencies can be discretely set.

The above mentioned are only illustrative, and it goes without saying that the present invention is not limited to these. For instance, the capacitive element that is loaded to the central portion of the transmission line is not limited to the illustrated square-shaped stub, but it is possible to employ stubs of various shapes such as one of interdigital, T-type, stepped impedance type or folding structure, and it is of course possible to employ a concentrated constant capacitive element. The loop shape of the single transmission line can be rectangular, circular, U-shaped or angular U-shaped, and arbitrary shapes are allowed. The capacitive elements can be disposed either within the loop or also outside the loop, and it can be arbitrarily determined whether or not to connect a capacitive element. The single transmission line can be mutually replaced either by a uniform line or a SIR. The distributed coupled lines can be used by combining serially connected first and second distributed coupled lines with the uniform line as shown in FIG. 3A and further load a capacitive element thereto.

2. Application Circuits Of The Transmission Line Resonator

Application circuits using the above-mentioned transmission line resonator with distributed coupled lines according to one or more embodiments of the present invention will now be explained.

2-1. Band-Pass Filter

The band-pass filter is a circuit to which signals of mixed frequencies are input and from which signals of specific frequencies are taken out.

Figure 10:
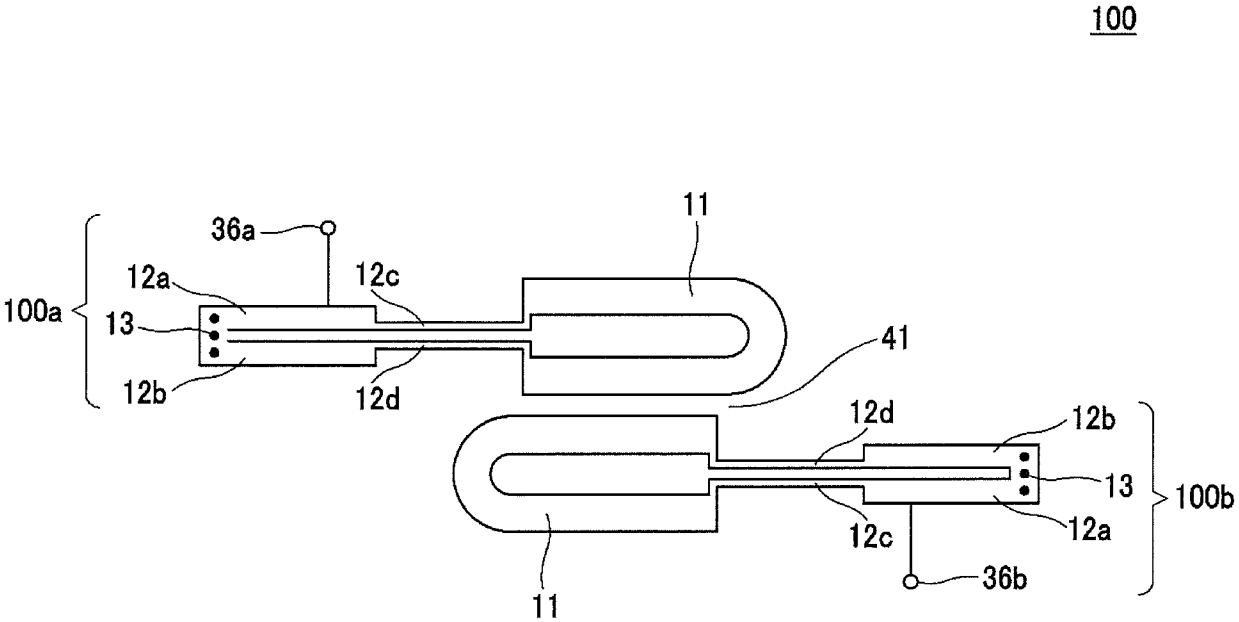
FIG. 10 is a view showing an application example in which a two-staged band-pass filter is configured using a modified example of the transmission line resonator with distributed coupled lines according to one or more embodiments of the present invention.

FIG. 10 is a view showing an application example in which a two-staged band-pass filter is configured using two resonators according to one or more embodiments of the present invention. The band-pass filter 100 comprises a first resonator 100*a* and a second resonator 100*b* of identical shape and identical resonance frequency. The first and second resonators 100*a*, 100*b* are of substantially identical configuration as that of the resonator as shown in FIG. 9D. More particularly, the first and second resonators 100*a*, 100*b* comprise first distributed loop lines 12*a*, 12*b* of parallel arrangement which respective one ends are connected to a short-circuit grounding portion 13 and second distributed coupled lines 12*c*, 12*d* of parallel arrangement which one ends are connected to the other ends of the first distributed coupled lines 12*a*, 12*b*. The uniform line 11 disposed in a U-shaped loop is connected to the other ends of the second distributed coupled lines 12*c*, 12*d*. An input terminal 36*a* for connection to an external circuit is tap-connected to one distributed constant line 12*a* of the first distributed coupled lines 12*a*, 12*b* of the first resonator 100*a*. An output terminal 36*b* for connection to an external circuit is tap-connected to one distributed constant line 12*a* of the first distributed coupled lines 12*a*, 12*b* of the second resonator 100*b*. The first and second resonators 100*a*, 100*b* are coupled by disposing straight linear portions of the U-shaped loop-like uniform lines 11 of the first and second resonators 100*a*, 100*b* to be separate from each other by a predetermined distance 41. In disposing the first and second resonators 100*a*, 100*b*, it is possible to position one to be reversed by 180 degrees with respect to the other for coupling or upon positioning them to face in the same direction for coupling as shown in FIG. 10. The coupling coefficient of the resonators can be adjusted by adjusting the separating distance 41 or positions of the respective resonators and to design and adjust properties of the filter.

While a configuration of a two-staged band-pass filter has been shown in FIG. 10, it is also possible to configure a band-pass filter of three or more stages by disposing three or more in a parallel and separated manner.

Figure 11:
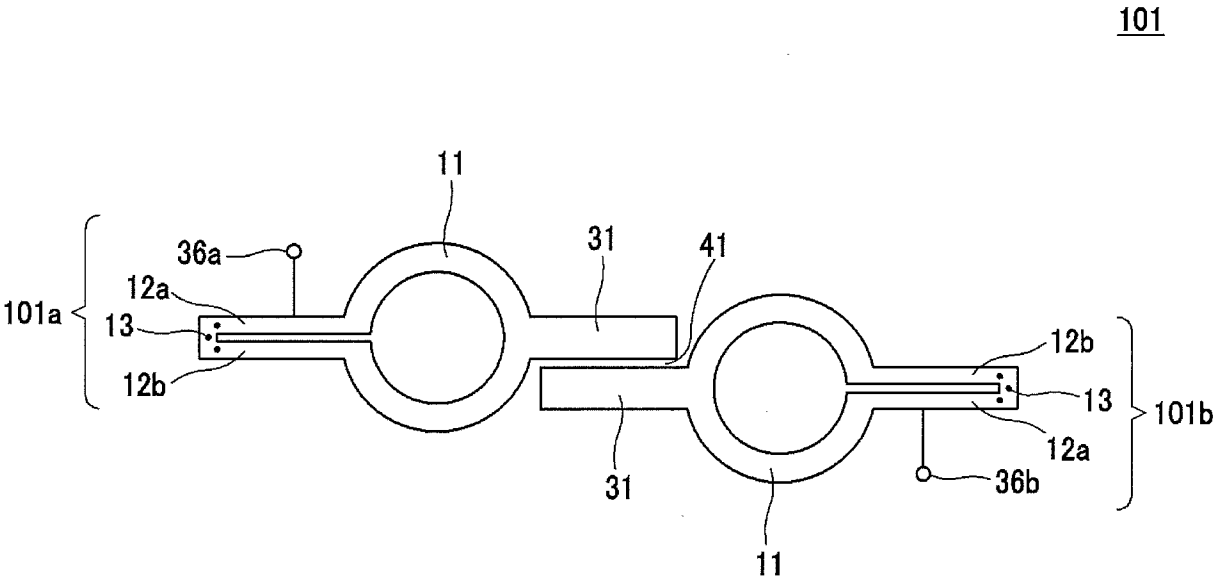
FIG. 11 is a view showing an application example in which a two-staged band-pass filter is configured using another modified example of the transmission line resonator with distributed coupled lines according to one or more embodiments of the present invention.

FIG. 11 shows an example in which a band-pass filter is configured by disposing two resonators in which a capacitive stub 31 is disposed outside of a circular loop of a uniform line 11 in a configuration of the resonator as shown in FIG. 9B. A band-pass filter 101 comprises a first resonator 101*a* and a second resonator 101*b* of identical shape and identical resonance frequency. The first and second resonators 101*a*, 101*b* are disposed in that one ends of distributed coupled lines 12*a*, 12*b* of parallel arrangement are respectively connected to a short-circuit grounding portion 13 and a uniform line 11 disposed in a circular loop-like shape is connected to the other ends of the distributed coupled lines 12*a*, 12*b*. A square stub 31 is connected to a central portion of the uniform line 11. An input terminal 36*a* for connection to an external circuit is tap-connected to one distributed constant line 12*a* of the distributed coupled lines 12*a*, 12*b* of the first resonator 101*a*. An output terminal 36*b* for connection to an external circuit is tap-connected to one distributed constant line 12*a* of the distributed coupled lines 12*a*, 12*b* of the second resonator 101*b*. In disposing the first and second resonators 101*a*, 101*b*, the stubs 31 can be approximated by disposing one to be reversed by 180 degrees with respect to the other as shown in FIG. 11. With this disposition the first and second resonators 101*a*, 101*b* can be coupled by disposing the stubs 31 of the first and second resonators 101*a*, 101*b* to be separated from each other by a predetermined distance 41. Similar to the case of FIG. 10, the coupling coefficient of the resonators can be adjusted by adjusting the separating distance 41 or positions of the respective resonators and to design and adjust properties of the filter.

Figure 12:
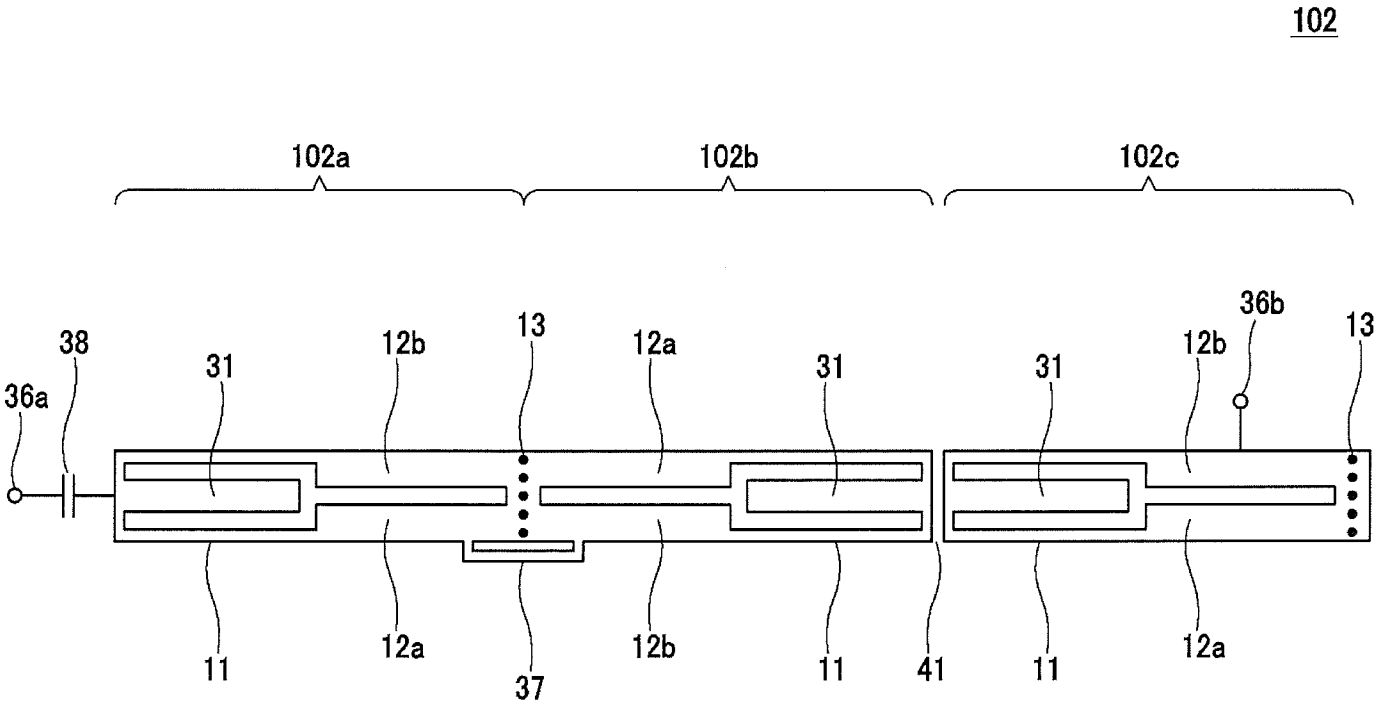
FIG. 12 is a view showing an application example in which a three-staged band-pass filter is configured using another modified example of the transmission line resonator with distributed coupled lines according to one or more embodiments of the present invention.

As shown in FIG. 12, the three-staged band-pass filter 102 is configured using three of the resonators as shown in FIG. 9C. More particularly, first, second and third resonators 102*a*, 102*b*, 102*c* of identical shape and identical resonance frequency comprise distributed coupled lines 12*a*, 12*b* of parallel disposition which one ends are respectively connected to a short-circuit grounding portion 13 whereas a uniform line 11 disposed in an angular U-shaped loop-like shape is connected to the other ends of the distributed coupled lines 12*a*, 12*b*. A capacitive stub 31 is connected to extend from a central portion of uniform line 11 with the angular U-shaped loop-like shape towards an inner side of the angular U-shaped loop. An input terminal 36*a* for connection to an external circuit is capacity-coupled to a central portion of the uniform line of the first resonator 102*a* by means of a coupling capacitor 38*a*. Further, an output terminal 36*b* for connection to an external circuit is tap-connected to one distributed constant line 12*b* of the distributed coupled lines 12*a*, 12*b* of the third resonator 102*c*. In disposing the first and second resonators 102*a*, 102*b*, they are connected to have their respective short-circuit grounding portions 13 in common in which one is reversed by 180 degrees with respect to the other. Coupling of the first and second resonators 102*a*, 102*b* is achieved by using a magnetic coupling loop 37. The second and third resonators 102*b*, 102*c* are coupled mainly through electric field coupling in which one is reversed by 180 degrees with respect to the other and the central portions of the uniform lines 11 are separated from each other by a predetermined distance 41.

While a three-staged band-pass filter has been shown in FIG. 12, it is also possible to employ four or more stages. By aligning elongated resonators in a longitudinal direction, it is possible to obtain an elongated shape of the band-pass filter itself. The possibility of configuring a band-pass filter to have an elongated shape means that input and output terminals can be configured to be apart from each other spatially since the input and output terminals are provided at outermost resonators so that it is possible to weaken coupling between input and output. There is accordingly the merit that it is possible to configure a filter circuit with separated input and output signals and with reduced wraparound of signals. In this respect, the strength of coupling between resonators can be adjusted by adjusting loop areas of the magnetic coupling loop 37 or the distance 41 for separating the resonators. The coupling coefficient of electric field can be adjusted by the separating distance 41, and if it is desired to further increase the coupling coefficient, it is possible to perform coupling by means of an interdigital capacitor.

The above-mentioned configuration of the band-pass filter is only illustrative and it can have various shapes, and it is possible to make arbitrary combinations as to employ a uniform line or a SIR, whether or not to load capacities, employ only one or connect two distributed coupled lines in series and so on. As for the connection of input and output terminals, positions of connection can be arbitrarily determined in accordance with distributions of electric fields or magnetic fields, and it is also possible to use capacity connection and tap connection in combination. In performing capacity connection, not only concentrated constant capacitive elements but also distributed constant capacitance elements such as stubs of various shapes can be used.

2-2. Cross-Coupled Filter

Figure 13:
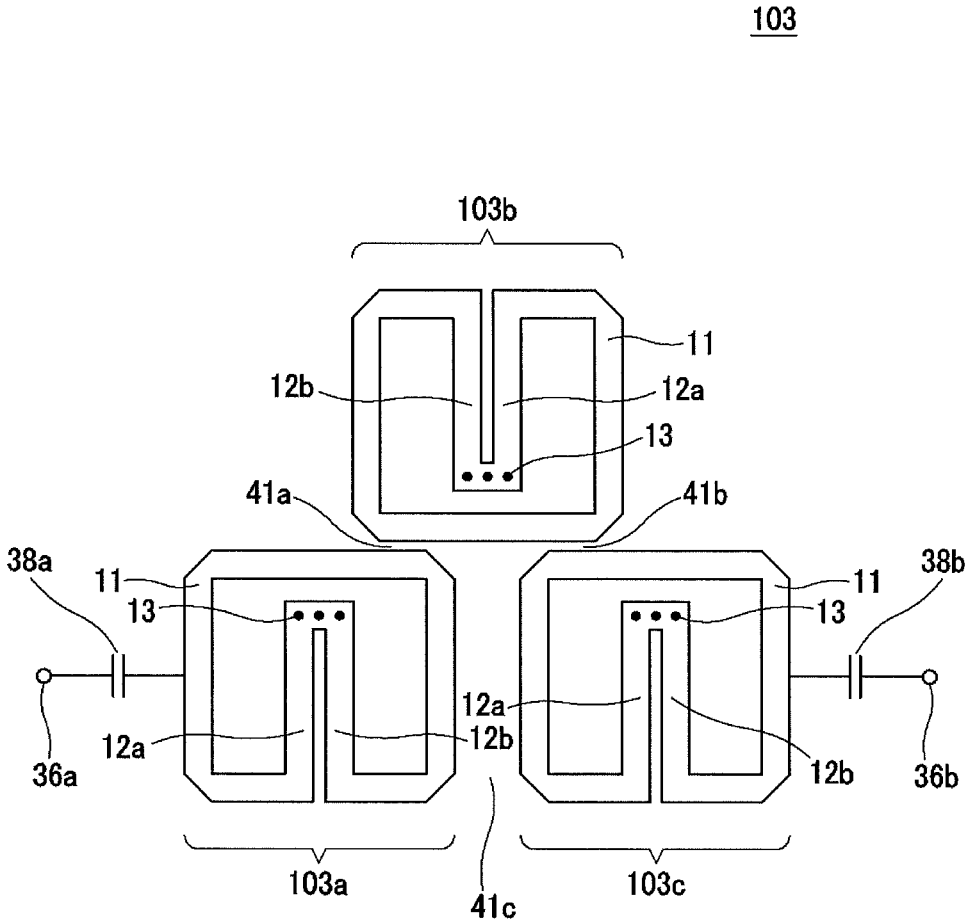
FIG. 13 is a view showing an example of a cross-coupled filter which is one type of a polarized filter in which positions of attenuation poles of a stopband are adjusted by weakly coupling input and output resonators using another modified example of the transmission line resonator with distributed coupled lines of one or more embodiments of the present invention.

A cross-coupled filter is one type of a polarized filter and is used in cases in which steep attenuation properties are required. FIG. 13 is a view showing an application example of a cross-coupled filter comprising three resonators. The cross-coupled filter 103 comprises three resonators 103*a*, 103*b*, 103*c* of identical shape and identical resonance frequency. The first, second and third resonators 103*a*, 103*b*, 103*c* comprise distributed coupled lines 12*a*, 12*b* of parallel arrangement which one ends are respectively connected to a short-circuit grounding portion 13, and a uniform line 11 disposed in a rectangular loop-like shape is connected to the other ends of the distributed coupled lines 12*a*, 12*b*. An input terminal 36*a* for connection to an external circuit is capacity-coupled to one side of the uniform line 11 of the first resonator 103*a* by means of a coupling capacitor 38*a*. An output terminal 36*b* for connection to an external circuit is capacity-coupled to one side of the uniform line 11 of the third resonator 103*c* by means of a coupling capacitor 38*b*. The first and second resonators 103*a*, 103*b* are disposed in parallel while the mostly approximating uniform lines 11 are separated from each other by a first distance 41*a*. The second and third resonators 103*b*, 103*c* are also disposed in parallel while the mostly approximating uniform lines 11 are separated from each other by a second distance 41*b*. When the first and third resonators 103*a*, 103*c* with input and output terminals are disposed to be separated from each other by a third distance 41*c*, inputs and outputs are coupled by a coupling coefficient that corresponds to the separated distance, and it is possible to adjust positions of attenuation poles in a stopband of the band-pass filter.

While a three-staged cross-coupled filter has been shown in FIG. 13, it is also possible to realize a cross-coupled filter of four or more stages by coupling inputs and outputs. While the second resonator 103*b* is disposed in that it is reversed by 180 degrees with respect to the first and third resonators 103*a*, 103*c* in FIG. 13, it is also possible to dispose all of the resonators 103*a*, 103*b* and 103*c* in the same direction or upon reserving by 90 degrees, and various disposition in accordance with coupling coefficient or arrangement spaces are possible. Positions or coupling methods of the input and output terminals can also be arbitrarily set. The shape of the resonator is also variable, and it is possible to make arbitrary combinations as to employ a uniform line or a SIR, whether or not to load capacities, to employ only one or connect two distributed coupled lines in series and so on as it has been already mentioned. In this respect, positions of the poles can be set by combining not only the input and output resonators but also arbitrary resonators to thus configure a polarized filter.

2-3. Electronic Tuning Type Filter

Figure 14:
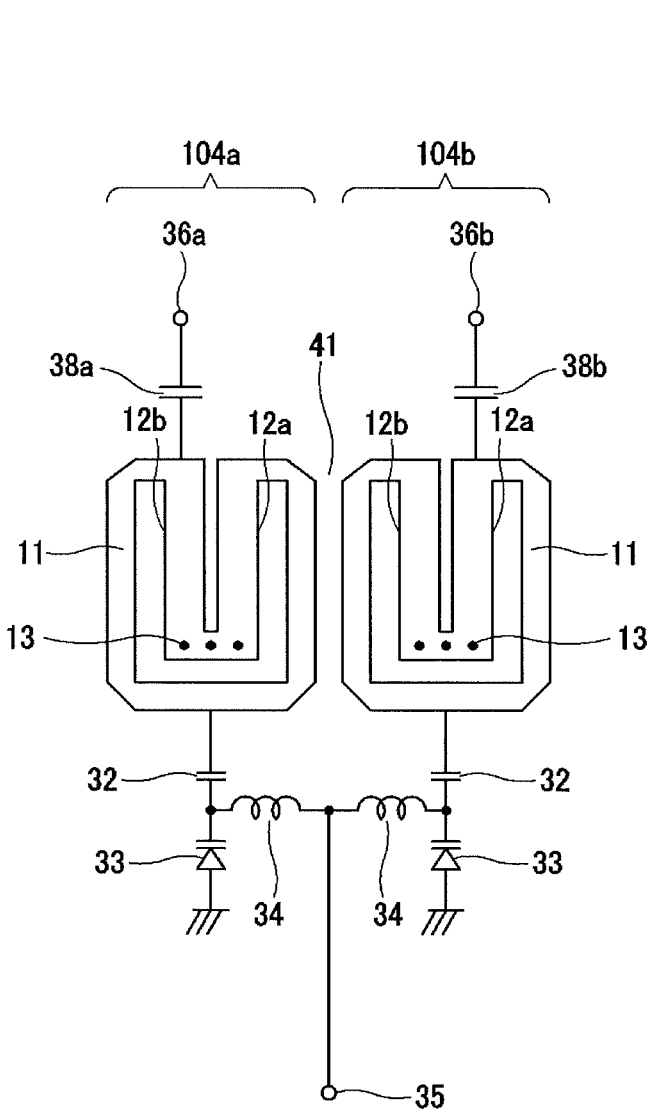
FIG. 14 is a view showing an example in which an electronic tuning type band-pass filter is configured using two transmission line resonators with distributed coupled lines according to one or more embodiments of the present invention of electronic tuning type by using a variable capacitance diode as a capacitive element loaded on a central portion of a single transmission line.

FIG. 14 is an electronic tuning type filter in which two of the electronic tuning type resonators as shown in FIG. 9E are coupled.

An electronic tuning type resonator 104 comprises first and second electronic tuning type resonators 104*a*, 104*b* of identical shape. The first and second electronic tuning type resonators 104*a*, 104*b* comprise distributed coupled lines 12*a*, 12*b* of parallel arrangement which one ends are respectively connected to a short-circuit grounding portion 13, and a uniform line 11 disposed in a rectangular loop-like shape is connected to the other ends of the distributed coupled lines 12*a*, 12*b*. An input terminal 36*a* for connection to an external circuit is tap-connected to one side of the uniform line 11 of the first electronic tuning type resonator 104*a*. An output terminal 36*b* for connection to an external circuit is tap-connected to one side of the uniform line 11 of the second electronic tuning type resonator 104*b*. A capacitive element that is loaded to a central portion of the uniform line 11 is obtained by serially connecting a DC block capacitor 32 and a variable capacitance diode 33, whereupon an external voltage terminal 35 is connected to a connecting position between the DC block capacitor 32 and a variable capacitance diode 33 by means of a high frequency choke coil 34. The first and second electronic tuning type resonators 104*a*, 104*b* are coupled by disposing straight linear portions of the uniform lines 11 of the first and second electronic tuning type resonators 104*a*, 104*b* in parallel while being separated from each other by a predetermined distance 41. It is possible to adjust the coupling coefficient of the resonators by adjusting the separating distance 41 or positions of the respective resonators and to design and adjust properties of the filter. In this respect, since the variable capacitance diode 33 has generally a large loss, in case central frequencies to be extracted by the filters are discrete, it is possible to employ a plurality of types of concentrated constant capacitive elements with low loss such as laminated ceramic capacitors instead of the variable capacitance diode which are converted by means of a switch. The configuration is not limited to the two-staged configuration as that of FIG. 14 but can also be of three-staged configuration or more, and the shape can also be arbitrarily set as discussed above. Connecting positions and connecting methods of input and output terminals can also be arbitrarily set as discussed above.

2-4. Multiplexer

A multiplexer r is a circuit for respectively outputting output signals of different frequency components included in input signals by making the input signals with a plurality of frequency components pass through filters of different pass bands. In this respect, it is possible to use it as an antenna sharing device with the same circuit configuration by reversing a part of directions of the input and output signals. The antenna sharing device is a circuit that transmits and receives transmitting signals and receiving signals of different frequencies with a single antenna in a radio equipment or the like, and is comprised of a filter through which transmitting signals generated within the equipment are made to pass and are transmitted to the antenna, and a filter through which receiving signals from the antenna are made to pass and are sent to a receiving circuit within the equipment.

Figure 15:
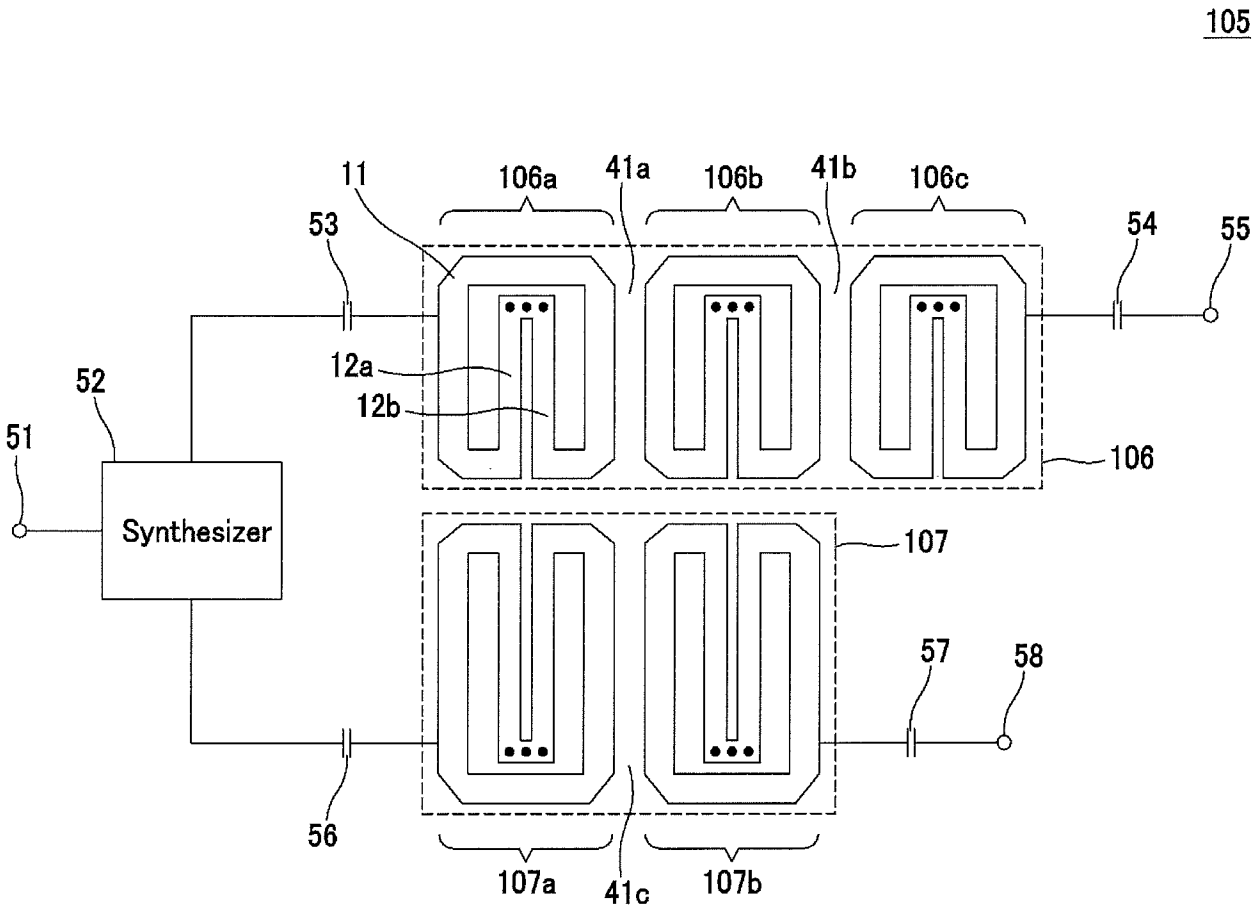
FIG. 15 is a view showing an example in which a multiplexer is configured using two band-pass filters which are band-pass filters of different passbands obtained by using a variation of the transmission line resonator with distributed coupled lines according to one or more embodiments of the present invention. By employing a frequency antenna at the input, for example, using one output as a transmission output and the other output as a receiving input, it is possible to utilize it as an antenna sharing device.

As shown in FIG. 15, the multiplexer 105 comprises a first band-pass filter 106 having a first central frequency $f_1$ which is a three-staged configuration of the resonators 106*a*, 106*b*, 106*c* according to one or more embodiments of the present invention and a second band-pass filter 107 having a second central frequency $f_2$ which is a two-staged configuration of the resonators 107*a*, 107*b* according to one or more embodiments of the present invention. The resonators 106*a*, 106*b*, 106*c* are of identical shape and identical resonance frequency, and the resonators 107*a*, 107*b* are of identical shape and identical resonance frequency which are different from those of the resonators 106*a*, 106*b*, 106*c*. As explained with reference with FIG. 10 and others, a band-pass filter circuit is configured by coupling respective resonators upon disposing them to be respectively separate from each other by predetermined distances 41*a*, 41*b*, 41*c*. An input terminal 51 is connected to the first band-pass filter 106 and the second band-pass filter 107 by means of a synthesizer 52 for performing impedance matching between an external circuit that is connected to the input terminal 51 and the respective circuits. Capacity coupling through coupling capacitors 53, 56 is used for connection of the synthesizer 52 and the first and second band-pass filters 106, 107. It comprises a first output terminal 55 that is capacity-coupled to the first band-pass filter 106 by means of a coupling capacitor 54 for obtaining output signals that correspond to the first central frequency $f_1$, and a second output terminal 58 that is capacity-coupled to the second band-pass filter 107 by means of a coupling capacitor 57 for obtaining output signals that correspond to the second central frequency $f_2$.

Upon input of input signals including the first and second central frequencies $f_1$, $f_2$ from the input terminal 51, they pass through the first band-pass filter 106, and output signals with the first central frequency $f_1$ are obtained from the output terminal 55. Further, the input signals pass through the second band-pass filter 107, and output signals with the second central frequency $f_2$ are obtained from the output terminal 58.

While the above operations are operations as a multiplexer, the following operations will take place in case of an antenna sharing device.

A transmitting and receiving antenna (not shown) is connected to the input terminal 51. The first output terminal 55 is used as a transmitting signal input, and signals of the first central frequency $f_1$ are made to pass through the first band-pass filter 106 and transmitted to the transmitting and receiving antenna. On the other hand, receiving signals received by the transmitting and receiving antenna pass through the second band-pass filter 107 and are output from the second output terminal 58 as receiving signals of the second central frequency $f_2$.

While a case with two band-pass filters has been explained in FIG. 15, the number is not limited to two but it is possible to configure a multiplexer for obtaining corresponding arbitrary frequency outputs with the arbitrary number of band-pass filters. The band-pass filters comprising the multiplexer can be configured, as discussed above, by combining the arbitrary number of resonators of one or more embodiments of the present invention of arbitrary shape in accordance with predetermined designing conditions.

3. Summary

In this manner, it is possible to realize resonators in design with more flexibility of small size, low loss and high Q values by using the transmission line resonator with distributed coupled lines of one or more embodiments of the present invention, and to realize high frequency application circuits such as a band-pass filter, polarized filter, electronic tuning type filter or multiplexers as discussed above.

To design with more flexibility means that it is possible to realize application designs to various frequency bands, and it is also easy to correspond to multiband which is required for radio devices in these years.

By applying one or more embodiments of the present invention to elements for configuring filters and oscillators for RFs, microwaves or millimeter wave bands, it is possible to contribute to its downsizing and high functionality. The application of variable capacitance elements will realize electronically controllable resonator properties. This contributes to realization of reconfigurable properties that are inevitable for future radio devices such cognitive radio systems. Further, since strip lines or micro-strip lines are used as transmission lines, further downsizing of circuits can be expected through application of manufacturing processes such as LTCC techniques or RF/CMOS techniques.

SIRs comprising the resonator of one or more embodiments of the present invention are already put into use in microwave band devices so that further downsizing, high performance and high functionality can be achieved by applying the technique of one or more embodiments of the present invention. Accordingly, it is possible to contribute to downsizing, reduction of loss and high functionality of filtering devices such as multi-staged filters or electronic tuning type filters using the resonator of one or more embodiments of the present invention, radio communication devices such as variable tuning circuits applied in voltage control oscillators or devices for measuring devices.

In these years, outstanding progresses have been made in RF/CMOS process techniques related to microwave and millimeter wave ICs. Consequently, technical trends are being actualized in that passive devices which had so far been provided externally are all integrated within IC chips and realized as one-chip radio ICs from the perspective of IPDs (Integrated Passive Devices). Properties and functions of the resonator according to one or more embodiments of the present invention are expected to be made use of in such technical trends as a resonator with low loss and high Q values and a resonator with broadband tuning functions.

As explained so far, the resonator of one or more embodiments of the present invention is expected to be widely applied as a basic element of RF or microwave band, and its industrial value is extremely high.

The transmission line resonator, the band-pass filter, the polarized filter, the electronic tuning type filter and the multiplexer as explained above are for explaining concrete examples, and it goes without saying that the present invention is not limited to the above-mentioned embodiments and that various changes are possible without departing from the scope of the present invention.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

11 . . . uniform line; 12*a*, 12*b*, 12*c*, 12*d* . . . distributed coupled line; 13 . . . short-circuit grounding portion; 21 . . . uniform line; 22 . . . first transmission line; 23 . . . second transmission line; 24 . . . third transmission line; 31 . . . stub; 32 . . . DC block capacitor; 33 . . . variable capacitance diode; 34 . . . high frequency choke coil; 35 . . . extemal voltage terminal; 36*a* . . . input terminal; 36*b* . . . output terminal; 37 . . . magnetic coupling loop; 38, 38*a*, 38*b* . . . coupling capacitor; 41, 41*a*, 41*b*, 41*c* . . . distance; 51 . . . input terminal; 52 . . . synthesizer; 53, 54 . . . coupling capacitor; 55 . . . flrst output terminal; 56, 57 . . . coupling capacitor; 58 . . . second output terminal; 100 . . . band-pass filter; 100*a* . . . first resonator, 100*b* . . . second resonator; 101 . . . band-pass filter; 101*a* . . . first resonator; 101*b* . . . second resonator; 102 . . . band-pass filter; 102*a* . . . first resonator; 102*b* . . . second resonator; 102*c* . . . third resonator; 103 . . . cross-coupled filter; 103*a* . . . first resonator; 103*b* . . . second resonator; 103*c*. . . third resonator; 104 . . . electronic tuning filter; 104*a* . . . first resonator; 104*b* . . . second resonator; 105 . . . multiplexer; 106 . . . first band-pass filter, 106*a*, 106*b*, 106*c*, 107*a*, 107*b* . . . resonator; 107 . . . second band-pass filter

The invention claimed is:

1. A transmission line resonator, including:

distributed coupled lines comprised of first distributed constant line which one ends are connected to a short-circuit grounding portion and second distributed constant line which is disposed in parallel to the first distributed constant line while being separated therefrom by a predetermined distance and which one ends opposing the short-circuit grounded one ends of the first distributed constant line are connected to the short-circuit grounding portion, and a single transmission line which both ends are connected to the respective other ends of the distributed coupled lines, wherein the distributed coupled lines have an even mode impedance and/or odd mode impedance, and wherein a resonance frequency of the transmission line resonator reduces in accordance with increases in a coupling coefficient of the distributed coupled lines which is given by an equation satisfying the following conditions:

$$k=(Zce-Zco)/(Zce+Zco),0\leq k\leq 1$$

where k is the coupling coefficient, Zce the even mode impedance and Zco the odd mode impedance.

2. The transmission line resonator according to claim 1, wherein the single transmission line is a first transmission line having a first line impedance and a first line length or a stepped impedance transmission line comprised of a second transmission line having a second line impedance and a second line length, a third transmission line having a third line impedance and a third line length which one end is connected to one end of the second transmission line, and a fourth transmission line having the third line impedance and the third line length which one end is connected to other end of the second transmission line.

3. The transmission line resonator according to claim 1, wherein the distributed coupled lines include first distributed coupled lines comprised of first distributed constant line which one ends are connected to the short-circuit grounding portion and second distributed constant line which is disposed in parallel to the first distributed constant line while being separated therefrom by a predetermined distance and which one ends opposing the short-circuit grounded one ends of the first distributed constant line are connected to the short-circuit grounding portion, and second distributed coupled lines comprised of third distributed constant line which is different from the first and second distributed constant lines and fourth distributed constant line which is disposed in parallel to the third distributed constant line while being separated therefrom, respective one ends thereof being connected to the respective other ends of the first distributed coupled lines, wherein both ends of the single transmission line are connected to the respective other ends of the second distributed coupled lines, wherein the first distributed coupled lines have a first even mode impedance and/or first odd mode impedance, wherein the second distributed coupled lines have a second even mode impedance and/or second odd mode impedance, and wherein a resonance frequency of the transmission line resonator reduces in accordance with increases in coupling coefficients of the first and second distributed coupled lines which are given by equations satisfying the following conditions:

$$k_1=(Zce_1-Zco_1)/(Zce_1+Zco_1),0\leq k_1\leq 1$$

$$k_2=(Zce_2-Zco_2)/(Zce_2+Zco_2),0\leq k_2\leq 1$$

where $k_1$,$k_2$ are the above first and second coupling coefficients, $Zce_1$, $Zce_2$ the above first and second even mode impedances and $Zco_1$, $Zco_2$ the above first and second odd mode impedances.

4. The transmission line resonator according to claim 1, further comprising a capacitive element which one end is connected to a central portion of the single transmission line and which other end is short-circuit grounded.

5. The transmission line resonator according to claim 4, wherein the capacitive element is any one of a concentrated constant element, a variable capacitance element or a distributed constant element.

6. The transmission line resonator according to claim 5, wherein the distributed constant element is either one of an interdigital capacitor, a rectangular stub, a stub with an impedance step, a T-type stub or a stub of folding line structure.

7. The transmission line resonator according to claim 3, wherein the single transmission line is disposed in a loop shape.

8. The transmission line resonator according to claim 7, wherein the ends of the distributed coupled lines or the first distributed coupled lines that are connected to the short-circuit grounded portion are disposed inside of a loop of the single transmission line disposed in a loop shape.

9. A band-pass filter, including two or more transmission line resonators of identical resonance frequency including distributed coupled lines comprised of first distributed constant line which one ends are connected to a short-circuit grounding portion and second distributed constant line which is disposed in parallel to the first distributed constant line while being separated therefrom by a predetermined distance and which one ends opposing the short-circuit grounded one ends of the first distributed constant line are connected to the short-circuit grounding portion, and a single transmission line both ends of which are connected to the respective other ends of the distributed coupled lines, wherein the single transmission line has a first line impedance and a first line length and is disposed in loop shape, wherein the distributed coupled lines have an even mode impedance and/or odd mode impedance and wherein the identical resonance frequency reduces in accordance with increases in coupling coefficients of the distributed coupled lines which are given by an equation satisfying the following conditions for resonating:

$$k=(Zce-Zco)/(Zce+Zco),0\leq k\leq 1$$

where k is the coupling coefficient, Zce the even mode impedances and Zco the odd mode impedances, having an input terminal that is coupled to one transmission line resonator from among the two or more transmission line resonators, and an output terminal that is coupled to another transmission line resonator from among the remaining one(s) of the two or more transmission line resonators, wherein the two or more transmission line resonators are coupled to adjoin each other while being separated from each other by a predetermined distance.

10. The band-pass filter according to claim 9, wherein the two or more transmission line resonators are three or more transmission line resonators, and wherein an arbitrary transmission line resonator from among the three or more resonators and another arbitrary transmission line resonator are coupled to each other.

11. A multiplexer, including two or more band-pass filters obtained by coupling two or more transmission line resonators of identical resonance frequency to adjoin each other while being separated from each other by a predetermined distance, the two or more transmission line resonators including distributed coupled lines comprised of first distributed constant line which one ends are connected to a short-circuit grounding portion and second distributed constant line which is disposed in parallel to the first distributed constant line while being separated therefrom by a predetermined distance and which one ends opposing the short-circuit grounded one ends of the first distributed constant line are connected to the short-circuit grounding portion, and a single transmission line both ends of which are connected to the respective other ends of the distributed coupled lines, wherein the single transmission line has a first line impedance and a first line length and is disposed in loop shape, wherein the distributed coupled lines have an even mode impedance and/or odd mode impedance, and wherein a resonance frequency reduces in accordance with increases in coupling coefficients of the distributed coupled lines which are given by an equation satisfying the following conditions:

$$k=(Zce-Zco)/(Zce+Zco),0\leq k\leq 1$$

where k is the coupling coefficient, Zce the even mode impedances and Zco the odd mode impedances, having input terminals that are coupled to respective inputs of the two or more band-pass filters, and output terminals that are coupled to a transmission line resonator other than the transmission line resonators with the respective input terminals for the two or more band-pass filters, and wherein the two or more band-pass filters have respectively different passbands.

* * * * *